US008157363B2

(12) United States Patent
Yamamoto

(10) Patent No.: US 8,157,363 B2
(45) Date of Patent: Apr. 17, 2012

(54) INK REMAINDER DETECTING MODULE FOR INK JET APPARATUS, INK CONTAINER WITH SAME AND INK JET APPARATUS

(75) Inventor: Hajime Yamamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 837 days.

(21) Appl. No.: 12/216,048

(22) Filed: Jun. 27, 2008

(65) Prior Publication Data

US 2008/0271316 A1 Nov. 6, 2008

Related U.S. Application Data

(62) Division of application No. 11/142,288, filed on Jun. 2, 2005, now Pat. No. 7,556,363.

(30) Foreign Application Priority Data

Jun. 3, 2004 (JP) ..... 2004-165889

(51) Int. Cl.
*B41J 2/175* (2006.01)
*B41J 2/195* (2006.01)

(52) U.S. Cl. ..... 347/86; 347/7

(58) Field of Classification Search ..... 347/19, 347/86, 7

See application file for complete search history.

(56) References Cited

U.S. PATENT DOCUMENTS

| | | | | |
|---|---|---|---|---|
| 5,289,211 | A | 2/1994 | Morandotti et al. | 347/7 |
| 5,775,164 | A | 7/1998 | Kishi | 73/304 R |
| 6,137,503 | A | 10/2000 | Hashimoto et al. | 347/19 |
| 6,616,255 | B2 | 9/2003 | Murakami et al. | 347/7 |
| 2002/0126164 | A1 | 9/2002 | Walker et al. | 347/7 |
| 2002/0135623 | A1 | 9/2002 | Tsukada et al. | 347/7 |
| 2003/0151648 | A1* | 8/2003 | Suda et al. | 347/85 |
| 2004/0036734 | A1 | 2/2004 | Mochizuki et al. | 347/19 |
| 2004/0056910 | A1 | 3/2004 | Usui et al. | 347/7 |
| 2005/0270341 | A1 | 12/2005 | Yamamoto et al. | 347/85 |
| 2005/0270347 | A1 | 12/2005 | Yamamoto | 347/86 |
| 2005/0275698 | A1 | 12/2005 | Noguchi et al. | 347/85 |

FOREIGN PATENT DOCUMENTS

| | | |
|---|---|---|
| EP | 1382449 | 1/2004 |
| JP | 7-164626 | 6/1995 |
| TW | 562749 | 11/2003 |

OTHER PUBLICATIONS

European Office Action dated Jun. 3, 2009, from corresponding European Application No. 05011943.7.

European Office Action dated Jul. 14, 2008, from corresponding European Application No. 05011943.7.

* cited by examiner

*Primary Examiner* — Julian Huffman

(74) *Attorney, Agent, or Firm* — Fitzpatrick, Cella, Harper & Scinto

(57) ABSTRACT

An ink remaining amount detection module, mountable to an ink container, for detection of an ink remaining amount in an ink container for ink jet recording, the ink remaining amount detection module, includes a support substrate; at least one detection electrode provided on one side of the support substrate; and readable and writable non-volatile information storing means provided on the one side of the support substrate; and information transmitting means, provided on the support substrate, for transmitting, to an outside, information relating to an ink remaining amount which is provided depending on whether the detection electrode is contacted to ink, and for receiving, from an outside, information to be written in the information storing element.

8 Claims, 9 Drawing Sheets

INK REMAINDER DETECTING MODULE FOR INK JET APPARATUS, INK CONTAINER WITH SAME AND INK JET APPARATUS

This application is a division of U.S. application Ser. No. 11/142,288, filed Jun. 2, 2005, the contents of which is incorporated herein by reference.

FIELD OF THE INVENTION AND RELATED ART

The present invention relates to ink jet recording or printing, and more particularly to an ink remaining amount detecting module for detecting an ink remaining amount in an ink container containing ink to be supplied into an ink jet recording head, an ink container provided with such an ink remaining amount detecting module, and ink jet recording apparatus usable with such an ink container.

The ink jet recording uses at least a recording head for ejecting the ink and an ink container for accommodating the ink to be supplied into the recording head. Since the ink is consuming material, the ink container or an ink cartridge having integral ink container and recording head is detachably mountable to an ink jet recording apparatus in many cases, and when the ink container thereof is used up, it can be replaced with a new one.

Techniques for detecting the presence or absence of the ink in the ink container has been proposed and put into practice to notify the user of the necessity of replacement of the ink container. The methods for detecting the presence or absence of the ink include:

(1) a pair of electrodes is provided in the ink container, and the use is made with the current flowing through the ink to detect reaching of the ink level (height of the ink liquid surface) to a predetermined level.

(2) a prism having a refractive index approximately equal to the refractive index of the ink is provided on an inner wall surface of the ink container, and light is directed to the prism. The reaching of the ink level to a predetermined level is detected using a difference in the light refraction between when the position of the liquid surface of the ink is higher than the position of the prism and when it is lower than the prism.

(3) the use is made with a change in an electrostatic capacity between the ink in the ink container and an electrode provided outside the ink container to detect the reaching of the ink level to a predetermined level.

These methods are combined. Or, one or more of such methods are combined with a so-called dot count method wherein the amount of the used ink is deduced on the basis of the number of dots printed and the number of the ink ejection outlets.

Referring to FIG. 12, (*a*)-(*c*), the description will be made as to a conventional detection system for detecting a remaining amount of the ink optically, among the above-described methods.

FIG. 12, (*a*) is a sectional view of a conventional ink container 101 provided with means for detection the ink remaining amount optically. FIG. 12, (*b*) is a perspective view of a cup portion 102 of the ink container 101.

The ink container 101 comprises the cup portion 102 and a cap portion 103 which caps the cup portion 102 to provide a casing 104 for accommodating the ink. The inside of the casing 104 is partitioned into two spaces by a partition wall 114 formed with the cup portion 102, and the partition wall 114 has a communicating portion 109 at the lower portion thereof. One of the spaces is an ink accommodation chamber 106 for directly (substantially without ink retaining foam or the like) accommodating the ink, and is sealed except for the communicating portion 109 on the other hand space is a negative pressure generating member accommodating chamber 105 for accommodating a negative pressure generating member 111 for retaining the ink. The wall of the negative pressure generating member accommodating chamber 105 is provided with an ink supply port 110 for supplying the ink out into the recording head portion (unshown) and an air vent 108 for introducing the ambient air into the ink container 101 from the outside in accordance with the consumption of the ink. In FIG. 12, (*a*), the region of the negative pressure generating member 111 which retains the ink is indicated by hatching lines.

The wall surface of the partition wall 114 at the negative pressure generating member accommodating chamber 105 side is provided with gas introduction grooves 119 extending up from the communicating portion 109 to promote the ambient air introduction from the negative pressure generating member accommodating chamber 105 to the ink accommodation chamber 106. In the negative pressure generating member accommodating chamber 105, there is provided a buffering space which does not contain the negative pressure generating member 111 around the air vent 108.

When the ink is consumed from the negative pressure generating member 111 by the recording head portion to such an extent that gas-liquid interface 111*a* in the negative pressure generating member accommodating chamber 105 reaches a top end of the gas introduction groove 119 shown in FIG. 12, (*a*), the air is introduced into the negative pressure generating member accommodating chamber 105 by the subsequent ink consumption, and the introduced air enters the ink accommodation chamber 106 through the communicating portion 109. In place thereof, the ink in the ink accommodation chamber 106 is supplied into the generating member accommodating chamber 105 through the communicating portion 109 and fills the negative pressure generating member 111. This is called "gas-liquid exchanging operation"

Therefore, even if the ink in the negative pressure generating member accommodating chamber 105 is consumed by the recording head portion, the corresponding amount of the ink is supplied from the ink accommodation chamber 106 into the negative pressure generating member 111 so that gas-liquid interface 111*a* in the negative pressure generating member accommodating chamber 105 is maintained substantially at the constant level. Thus, the negative pressure generating member 111 retains therein a substantially constant amount of the ink, by which the negative pressure of the ink supplied to the recording head portion is maintained substantially at a constant level, thus stabilizing the ink supply to the recording head portion.

The bottom surface of the ink accommodation chamber 106 is provided with an optical reflection member 113 having a triangle prism shape having an apex angle of 90°, and the optical reflection member 113 is integrally molded with the cup portion 102. On the other hand, the main assembly of the ink jet recording apparatus (unshown) to which the ink container 101 is to be mounted, as shown in FIG. 12, (*c*), an optical sensor module 151 is provided below an optical reflection member 113, and the optical sensor module 151 has a light emitting portion 152 and a light receiving portion 153.

When there is no ink in the ink accommodation chamber 106, the light emergent from the light emitting portion 152 is incident on the optical reflection member 113, and is reflected by the two inclined surfaces of the prism to return to the light receiving portion 153 as indicated by solid lines in FIG. 12, (*c*). When the ink level is higher than the light incidence position to the inclined surface of the optical reflection member 113, the light emergent from the light emitting portion 152 and incident on the optical reflection member 113 mostly transmits the optical reflection member 113 as indicated by the broken line arrow. Therefore, the presence and absence of the ink can be detected on the basis of the light quantity of the light returning to the light receiving portion 153.

The structure of the ink container having such an optical ink remaining amount detecting means is disclosed in Japanese Laid-open Patent Application Hei 7-164626 (U.S. Pat. No. 6,137,503).

Recently, the ink jet recording apparatus becomes capable of printing full-color images, and therefore, the number of the used inks is increasing. This increases the kinds of the ink containers to be carried on the ink jet recording apparatus, and in view of this, the ink containers are given inherent information, respectively to prevent erroneous mounting of the ink containers. In order for the ink container to have the information inherent to the ink container, it is known to provide the ink container with a mechanical ID structure, to stick a bar cord label on the ink container and to provide the ink container with the information storing element such as a ROM.

SUMMARY OF THE INVENTION

The above-described recent trend increases the number of the colors of the ink and the number of the kinds of the ink containers. On the other hand, the smaller foot print, and downsizing, from the standpoint of mobile use, are also desired. The downsizing of the ink jet recording apparatus necessitates the downsizing of the ink container, and then, the ink remaining amount detecting means is desired to be small.

Conventionally, the information relating to the detected remaining amount of the ink is transmitted to the ink jet recording apparatus, the user is notified of the necessity of the replacement of the ink container by the ink jet recording apparatus. Although it is known that ink container is provided with the inherent information, but the information is directed to the prevention of erroneous mounting of the ink containers.

Accordingly, it is a principal object of the present invention to provide an ink container, an ink cartridge and an ink jet apparatus, wherein the information relating to the ink accommodated in the ink container can be detected with a simple structure, and the detected information can be easily and assuredly stored.

According to a first aspect of the present invention there is provided an ink remaining amount detection module, mountable to an ink container, for detection of an ink remaining amount in an ink container for ink jet recording, said ink remaining amount detection module, comprising a support substrate; at least one detection electrode provided on one side of said support substrate; and readable and writable non-volatile information storing means provided on said one side of said support substrate; and information transmitting means, provided on said support substrate, for transmitting, to an outside, information relating to an ink remaining amount which is provided depending on whether said detection electrode is contacted to ink, and for receiving, from an outside, information to be written in said information storing element.

According to this aspect of the present invention, the detection electrode, the information storing means and information transmitting means are provided on the support substrate, it is suitable for mounting on a small size ink container, and therefore, an ink remaining amount detection module which is compact and simple can be provided since the information storing means is non-volatile memory, the information According to a second aspect of the present invention, there is provided an ink container comprising an ink chamber for accommodating ink; an ink supply port for supplying the ink into a recording head from said ink chamber; an ink remaining amount detection module as defined in the first aspect; said ink container further comprising: a casing member constituting an outer wall and said ink supply port of said ink chamber, wherein said ink remaining amount detection module is mounted on said casing member with said detection electrode exposed to inside of said ink chamber.

According to this aspect of the present invention, the ink container can have the information relating to the ink remaining amount substantially without upsizing the ink container.

According to a further aspect of the present invention, there is provided an ink jet recording apparatus for effecting recording on a recording material using a recording head for ejecting ink supplied from an ink container as defined in the second aspect which is detachably mountable to said ink jet recording apparatus, said apparatus comprising a holding portion for detachably holding said ink container; and apparatus side information transmitting means for transmission and reception of information between itself and said ink remaining amount detection module through said information transmitting means of said ink remaining amount detection module mounted on said ink container.

According to this aspect of the present invention, the ink jet recording apparatus has the apparatus side information transmitting means for transmission and reception of the information between itself and the ink remaining amount detection module mounted on the ink container, the ink jet recording apparatus can control its operation on the basis of the information acquired from the ink remaining amount detection module, and the information relating to the ink remaining amount of the ink container can be possessed by the ink container per se.

According to a third aspect of the present invention, there is provided a manufacturing method for an ink container including an ink chamber accommodating inside and an ink supply port for supplying the ink from the ink chamber into a recording head, said method comprising a step of preparing a casing member constituting an outer wall of said ink chamber and said ink supply port, wherein said ink remaining amount detection module as defined in the first aspect is mounted to said ink chamber with said detection electrode exposed to inside of said ink chamber; a step of filling ink into said ink chamber; and a step of writing information indicative of presence of ink in said information storing means of said ink remaining amount detection module.

According to this aspect of the present invention, the data indicative of the presence of the ink is written in the ink remaining amount detection module after the ink is filled, the data can be easily and assuredly written in the ink container per se. in addition, a possible inconsistency between the information detected by the ink remaining amount detection module and the information retained in the information storing means when the ink container is refilled with ink.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Referring to the accompanying drawings, the embodiments of the present invention will be described.

Figure 1:
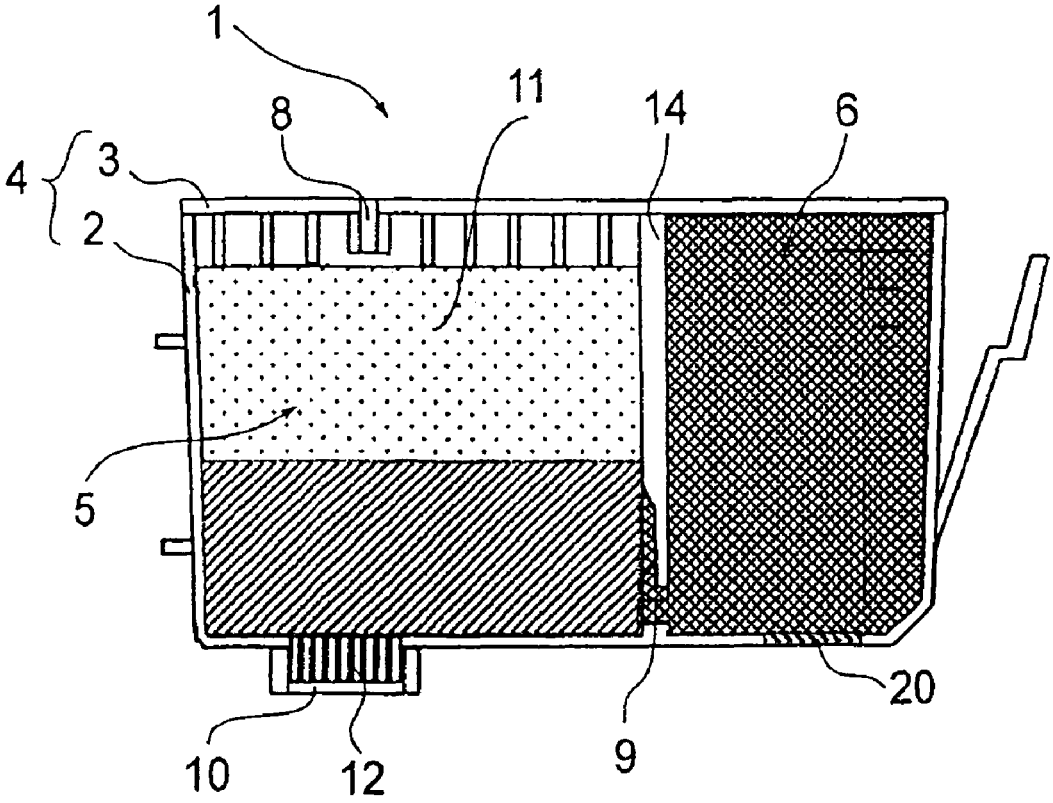
FIG. 1 is a sectional view of an ink container according to an embodiment of the present invention.
Figure 12:
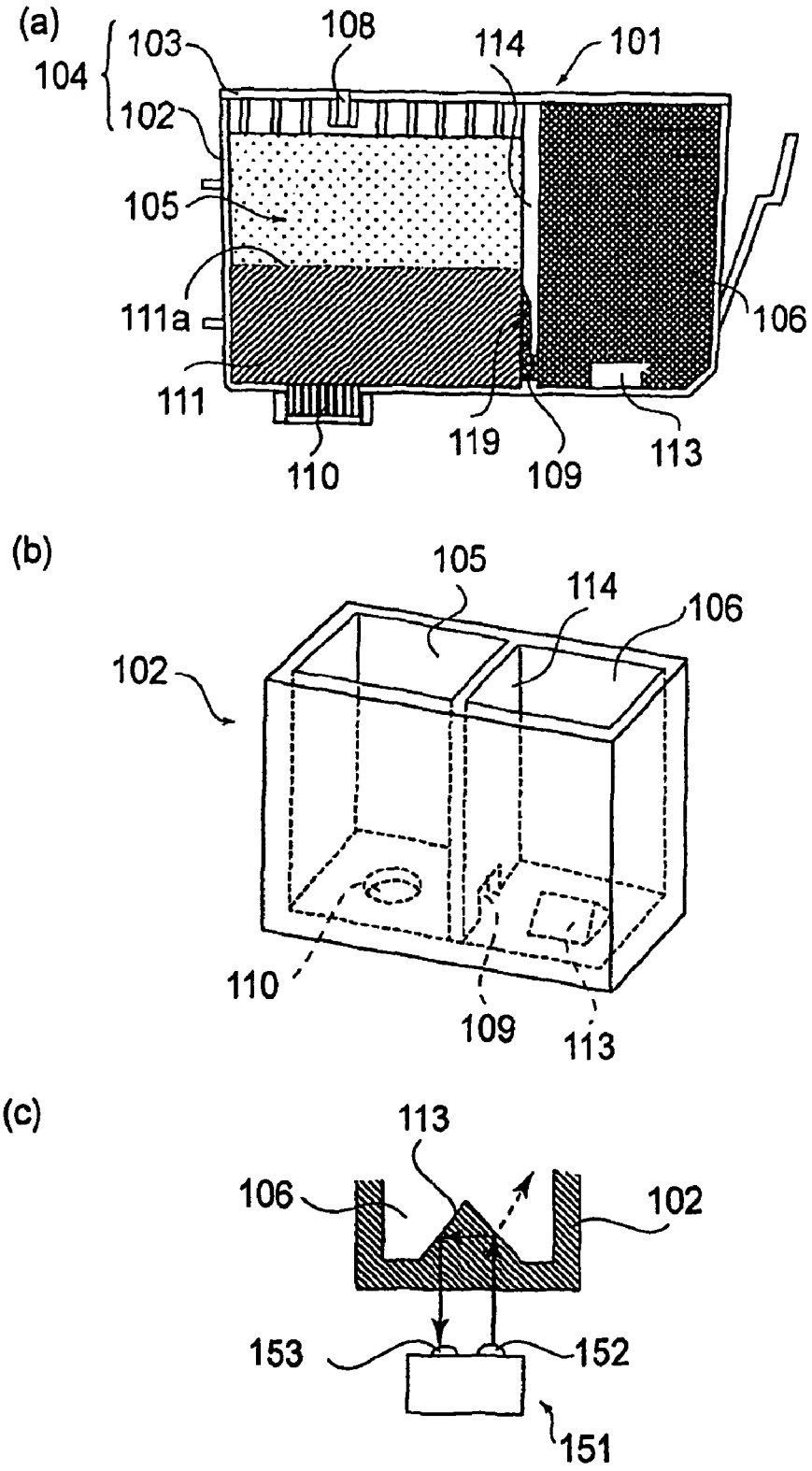
FIG. 12 illustrates an example of a conventional detection system for detecting a remaining amount of the ink optically.

FIG. 1 is a sectional view of an ink container according to an embodiment of the present invention. The ink container 1 of this embodiment has a basically the same structures as the ink container 101 shown FIG. 12. More particularly, the casing 4 is constituted by a cup portion 2 and a cap portion 3. The inside of the casing 4 is partitioned by a partition wall 14 into an ink accommodation chamber 6 which directly contains or is to contain the ink and a negative pressure generating member accommodating chamber 5 for accommodating a negative pressure generating member 11. The partition wall 14 is provided at a lower portion with a communicating portion 9. The wall surface constituting the negative pressure generating member accommodating chamber 5 is provided with an ink supply port 10 and an air vent 8. In the attitude of the ink container 1 in use (when the ink container 1 is operably set in the ink jet recording apparatus), the air vent 8 takes an upper part position, and the ink supply port 10 takes a lower position by forming the air vent 8 in the cap portion 3 and by forming the ink supply port 10 in the bottom wall of the cup portion 2. Between the negative pressure generating member 11 and the ink supply port 10, there is provided an ink leading member 12 for promoting the ink supply from the negative pressure generating member 11 into the ink supply port 10.

An ink remaining amount detection module 20 for detecting information relating to the ink remaining amount in the ink accommodation chamber 6, is provided in a region constituting the ink accommodation chamber 6. The structure relating to the ink remaining amount detection module 20 is different from the ink container 101 shown in FIG. 12. The detailed description will be made as to the ink remaining amount detection module 20.

Figure 2:
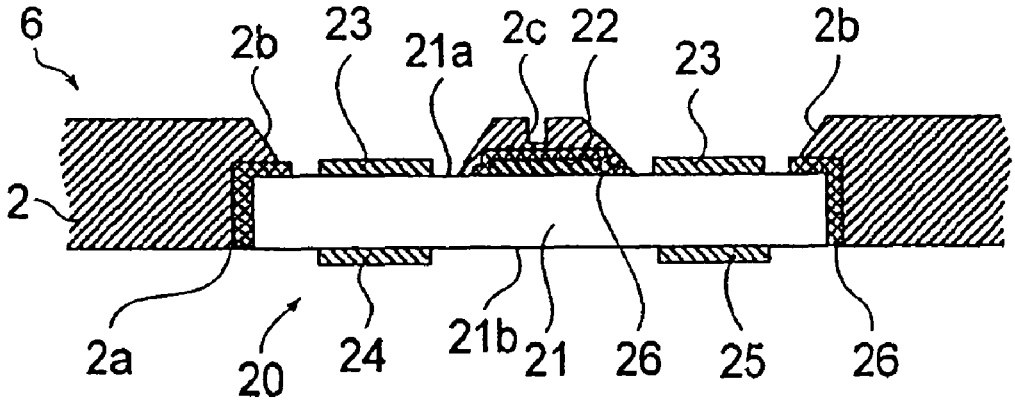
FIG. 2 is a sectional view of a part around the ink remaining amount detection module in the ink container of FIG. 1.
Figure 3:
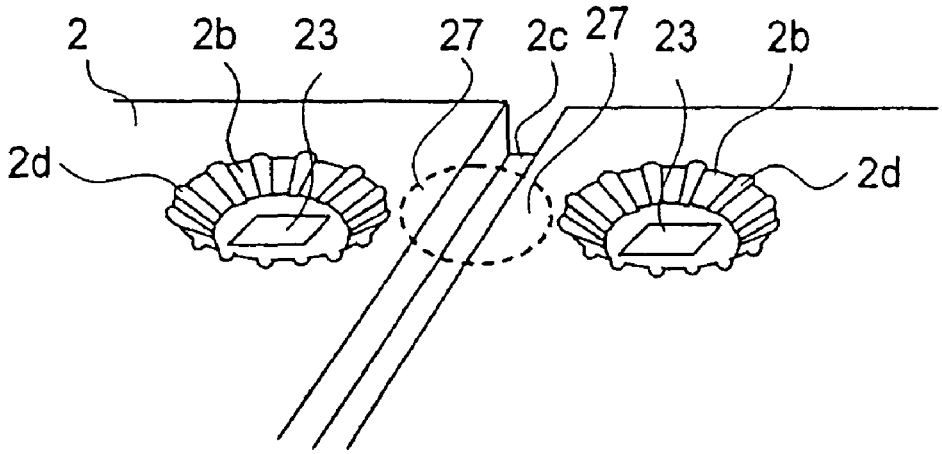
FIG. 3 is a perspective view of a part having the ink remaining amount detection module in the ink container of FIG. 1, as seen from an inside of the cup portion.
Figure 4:
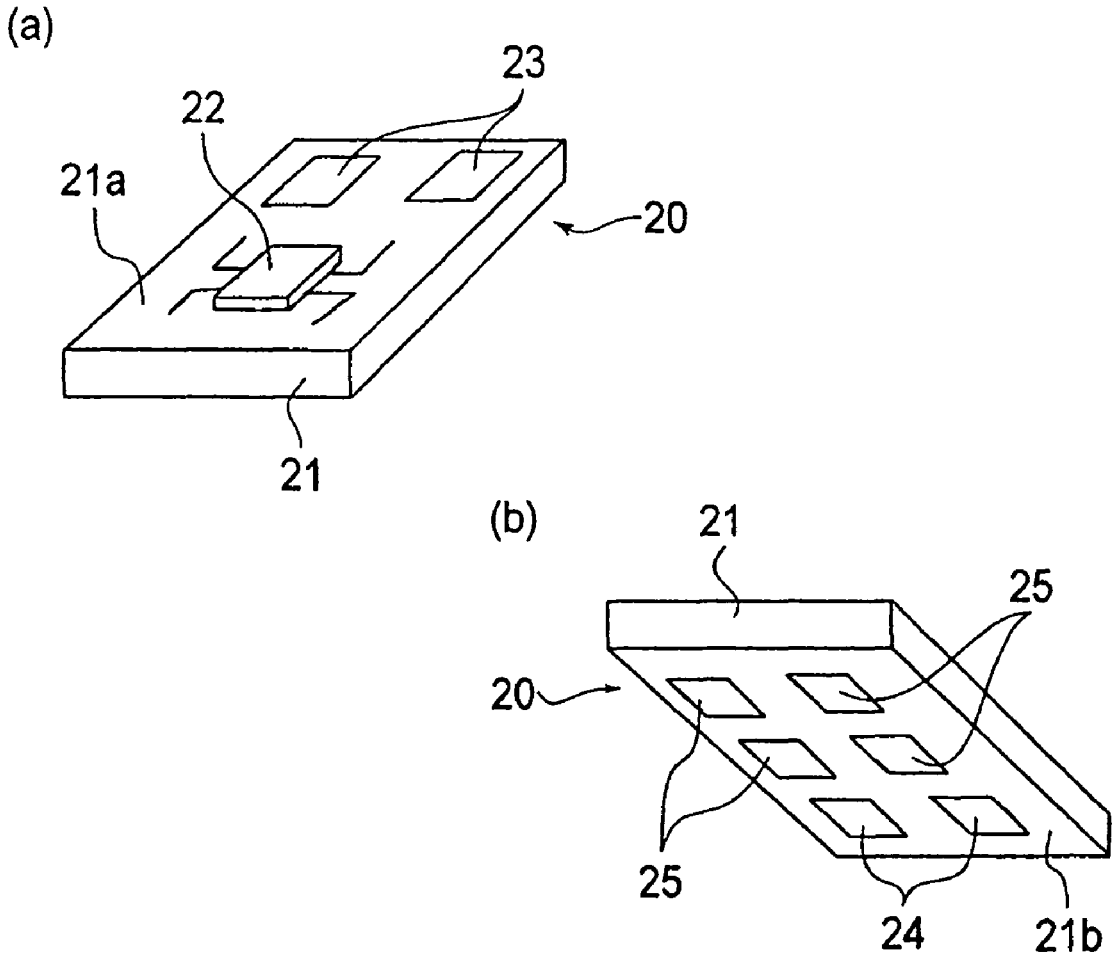
FIG. 4 is a perspective view of an ink remaining amount detection module shown in FIG. 2.

FIG. 2 is a sectional view of the ink container according to the embodiment of the present invention adjacent the ink remaining amount detection module. FIG. 3 is a perspective view of a part having the ink remaining amount detection module in the ink container according to this embodiment, as seen from an inside of the cup portion. FIG. 4 is a perspective view of an ink remaining amount detection module shown in FIG. 2. FIG. 2 is such a schematic sectional view that major structures relating to the ink remaining amount detection module 20 appear, and is not a view taken along a particular line.

Referring to FIG. 2-FIG. 4, the structure relating to the ink remaining amount detection module 20 will be described. The surface constituting an outer surface of the ink container 1 (FIG. 1) of the ink container 1 at the bottom wall of the cup portion 2, is provided with a recess 2*a*, and the ink remaining amount detection module 20 is fitted into the recess 2*a*. The ink remaining amount detection module 20 comprises a support substrate 21 and an information storing element 22 carried on a first surface 21*a* of the support substrate 21. The information storing element 22 in this embodiment is a non-volatile memory storing device from which the information can be electrically, magnetically or electromagnetically can be read or erased and to which the information can be electrically, magnetically or electromagnetically written. The information storing element 22 is covered with an unshown sealant and is protected.

A first surface 21*a* of the support substrate 21 is further provided with a pair of detection electrode 23 for the ink remaining amount detection in the ink accommodation chamber 6, and the electrodes 23 are spaced from each other. The second surface 21*b* of the support substrate 21 which is opposite the first surface 21*a* is provided with a pair of external contact electrodes 24 connected to a detection electrodes 23, respectively, and with an external contact electrodes 25 for a plurality of elements electrically connected with contacts of the information storing element 22.

In the recess 2*a* of the cup portion 2, there are provided two through-holes 2*b* penetrating in the direction of thickness of the cup portion 2. The through-holes 2*b* are formed at positions corresponding to the positions of the detection electrode 23 of the ink remaining amount detection module 20, and the detection electrodes 23 are exposed in the through-holes 2*b* to the inside of the ink accommodation chamber 6. By doing so, the second surface 21*b* of the support substrate 21 is directed outwardly of the ink container 1, and the external contact electrodes 24 for the detection and the external contact electrodes 25 for the elements are exposed at the outer surface of the ink container 1. The information storing element 22 and the gap between the ink remaining amount detection module 20 and the cup portion 2 are sealed by adhesive material 26, so that ink remaining amount detection module 20 is fixed, and the ink leakage from the ink accommodation chamber 6 is prevented.

In the inner wall surface of the cup portion 2, a separation groove 2*c* is formed between the through-holes 2*b*. By this, the regions at the respective sides of the separation groove 2*c* between the through-hole 2*b* are separation regions 27. This structure is effective to prevent formation of an ink bridge (ink connection) between the through-hole 2*b* despite the fact that ink in the ink accommodation chamber 6 is used up so that vacancy is to be detected. Another unsmoothness structure other than the separation groove 2*c* may be provided between the through-holes 2*b* in the inner wall surface of the cup portion 2.

Each of the through-holes 2*b* is in the form of a funnel as seen from the inside of the cup portion 2, so that when the remainder of the ink is small, the ink tends to concentrate in the through-holes 2*b*. In addition, as shown in FIG. 3, the inner side wall portions of the through-holes 2*b* (funnel surfaces) is provided with a plurality of capillary grooves 2*d* for generating capillary forces so as to direct the ink in the through-holes 2*b* toward the ink remaining amount detection module 20. By doing so, the ink in the through-hole 2*b* can be drawn onto the surface of the detection electrodes 23. when the ink container 1 (FIG. 1) is dismounted from the ink jet recording apparatus, the ink container 1 may be upside down, with the possible result that bubbles may attach to the side surface of the through-hole 2*b* or through-hole 2*b*. Even if this occurs, when the ink container 1 takes the mounting orientation then (the attitude during use), the capillary tube groove 2*d* is effective to retract the ink to the ink remaining amount detection module 20.

Figure 5:
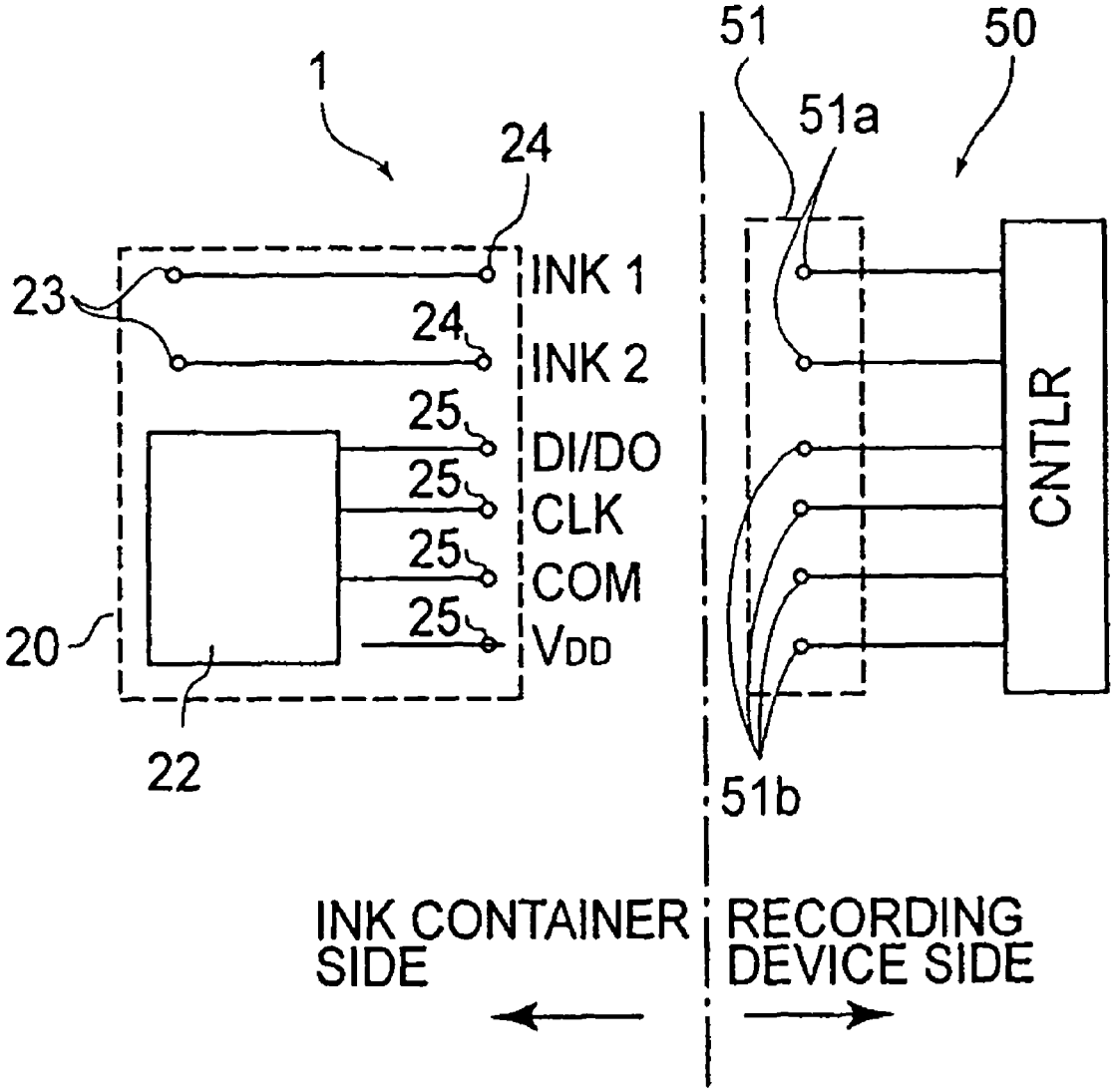
FIG. 5 illustrates an electrical structure of the ink remaining amount detection module in the embodiment of FIG. 1.

Electrical structures of the ink remaining amount detection module 20 are shown in FIG. 5. In the ink container 1 side, the external contact electrodes 25 for various elements connected to the information storing element 22 of the ink remaining amount detection module 20, are a data input/output contact DI/DO, a voltage source contact Vdd for driving the information storing element 22, a common contact COM for electric grounding. On the other hand, the ink jet recording apparatus 50 has the carriage 51 for detachably mounting the ink container 1, and the ink container 1 is mounted on the carriage 51. the carriage 51 detachably or integrally carries the ink jet recording head (unshown) for ejecting the ink, the ink is supplied into the ink jet recording head from the ink container 1. The supplied ink is ejected from the ink jet recording head to effect recording on the recording material made of paper or resin material sheet.

the carriage 51 is provided with a detection contacts 51*a* and contacts 51*b* for the elements for electric connection with the detection external contact electrode 24, the element external contact electrode 25, when the ink container 1 is mounted. the detection contact 51*a* and element contact 51*b* are electrically connected with a controller (unshown) of the ink jet recording apparatus 50, and the information provided from the contact 51*a* is processed by the controller if necessary, and then is inputted to the information storing element 22 through the contact 51*b*.

Figure 6:
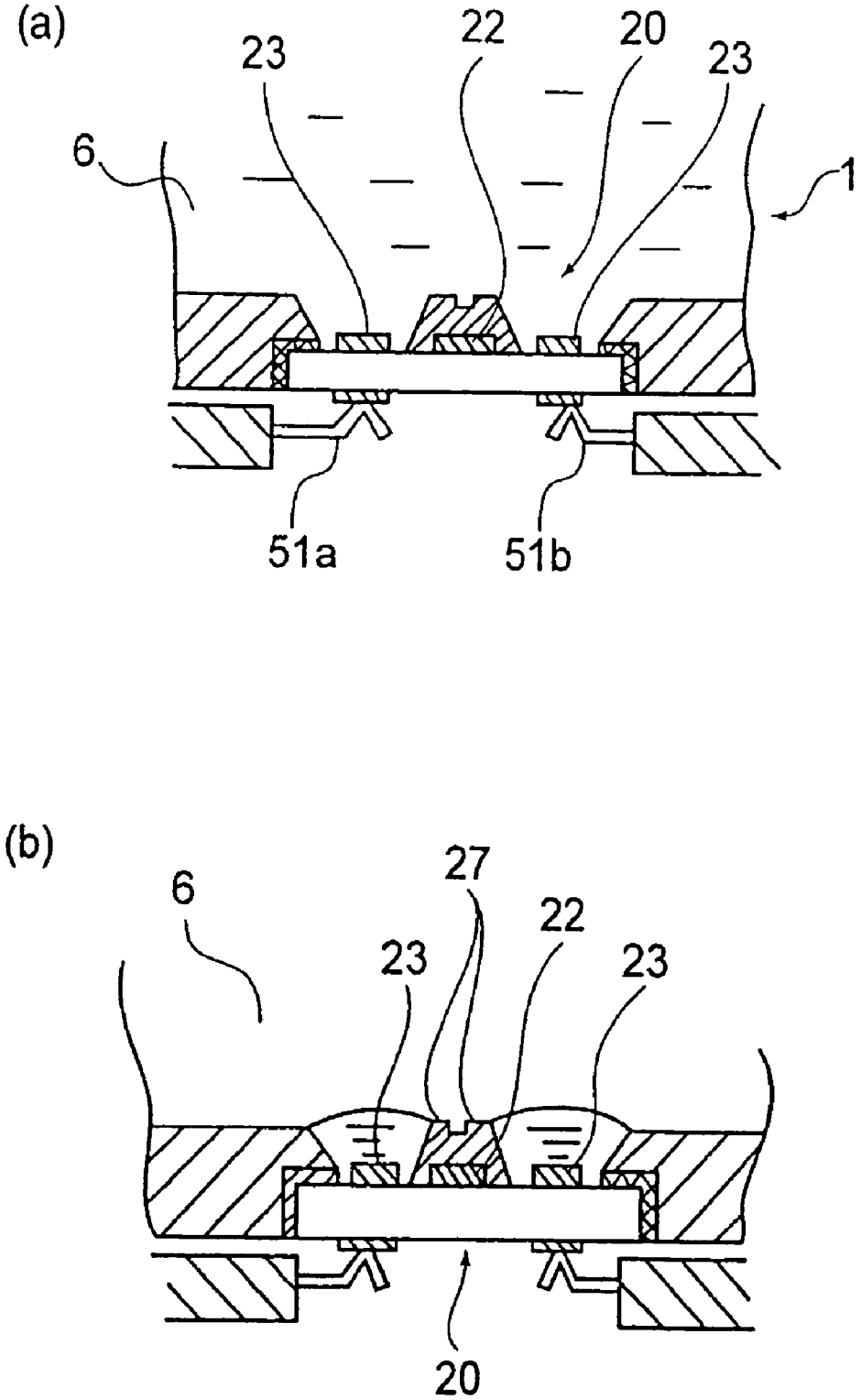
FIG. 6 illustrates a detecting operation by the ink remaining amount detection module in the embodiment of FIG. 1.

The detection contact 51*a* and the element contact 51*b* are electrically connected by contacting to the detection external contact electrode 24 and the element external contact electrode 25 by the ink container 1 being mounted to the carriage 51. in order to properly contact the detection contact 51*a* and the element contact 51*b* to the detection external contact electrode 24 and the element external contact electrode 25 when the ink container 1 is mounted to the carriage 51, the detection contact 51*a* and the element contact 51*b* are preferably in the form of leaf springs of electroconductive material, as shown in FIG. 6. the detection contact 51*a* and the element contact 51*b* shown in FIG. 6 are an example of the structure of the connecting portion relative to the ink container 1, and the configurations and dispositions may be properly changed.

Referring still to FIG. 6, the detection of the ink remaining amount in this embodiment will be described. When the amount of the ink in the ink accommodation chamber 6 is sufficient, the two detection electrodes 23 of the ink remaining amount detection module 20 are electrically connected with each other through the ink in the ink accommodation chamber 6, as shown in FIG. 6, (*a*). Therefore, the controller of the ink jet recording apparatus 50 discriminates that ink remains in the ink container 1 by detecting the current flowing between the detection electrodes 23 (presence of the ink). Then, the result of the discrimination of the controller (FIG. 5) of the ink jet recording apparatus 50 is written in the information storing element 22 of the ink remaining amount detection module 20 at proper timing through the data input/output contact (contact DI/DO in FIG. 5) as the information indicative of the ink.

When the ink in the ink accommodation chamber 6 is consumed, and the ink in the ink accommodation chamber 6 is separated between the two detection electrodes 23 by the separation region 27, the current stops between the detection electrodes 23. In response to the absence of the current between the detection electrodes 23, the controller of the ink jet recording apparatus 50 discriminates the absence of ink. In accordance with the result of discrimination, the controller renews the ink presence data of the information storing element 22 in the ink remaining amount detection module 20 through the data input/output contact, by which the absence of ink is written therein. The renewal of the data may be effected by overwriting the data which has been written in the information storing element 22 as the data indicating the presence of ink, or by additionally writing data indicative of the absence of ink in another storing region in the information storing element 22 with the data indicative of the presence of ink retained. Simultaneously, the controller notifies the user of the absence of ink through the ink jet recording apparatus 50 per se to promote replacement of the ink container 1, or stops the recording operation, as desired.

As described in the foregoing, according to the embodiments of the present invention, the detection electrodes 23 are provided on one side of the support substrate 21, and the external contact electrodes 24 for the detection are provided on the opposite thereof, so that assured ink remaining amount detecting means using the electric conductivity can be arranged in a small space. Furthermore, since no optical means is used, there is no liability of erroneous detection attributable to the deterioration in the reflectance of the reflection interface between the ink and the reflection member (prism, for example), and therefore, the ink container is suitable for reuse in which the ink is refill into the used ink container.

In addition, the information storing element 22 is carried on the support substrate 21, and therefore, the data relating to the ink remaining amount processed by the ink jet recording apparatus 50 after the detection by the detection electrode 23 can be written in the information storing element 22. As a result, by reading the data stored in the information storing element 22 using the element external contact electrode 25, the information relating to the ink remaining amount in the ink container 1 can be known by a simple way. In addition, the information storing element 22 is carried on the surface of the ink container 1 which faces inwardly thereof, and as a result, the information storing element 22 is protected by the support substrate 21, and therefore, the information storing element 22 is protected from damage.

The information relating to the ink remaining amount is not required to be strictly precise, but may be stepwise or so rough that it represents presence or absence of the ink, and therefore, the necessary amount of data is relatively small. The information storing element 22 may be a semiconductor chip element, and therefore, the size of the ink remaining amount detection module 20 is still small even if the information storing element 22 is carried. The information storing element 22 is not limited to those in which the information is overwritten by erasure and writing of information, but may those in which the information may be written in an additional area, if the writing and reading is possible.

By the capability of downsizing of the ink remaining amount detection module 20, the assured detection of the ink remaining amount and the storing of the information relating to the ink remaining amount can be incorporated in a small size ink container or in a small size ink jet recording apparatus.

In the foregoing description, the information handled by the ink remaining amount detection module 20 is the data indicative of the presence/absence of the ink. However, by detecting the level of the current flowing between the detection electrodes 23 at high precision, the state in which the ink amount is approaching to nothing can be detected. As shown in FIG. 6, (*b*), immediately before separation of the ink between the two detection electrodes 23, the electric resistance between the detection electrodes 23 is much higher, and therefore, the current is much smaller than when the amount of the ink is large, although the current between the detection electrodes 23 is not zero. Therefore, by detecting the change in the current immediately before the state in which no current flows between the detection electrodes 23, the smallness of the amount of the ink remaining amount in the ink accommodation chamber 6 can be detected. A three-dimensional configuration of the separation region 27 can be modified so as to enlarge the change in the current.

The information storing element 22 can store information other than the information relating to the ink remaining amount. For example, the information inherent to the ink container 1, the product number, the kind of the stored ink, the color, the manufacturing date, lot number or the like can be stored in the information storing element 22. These pieces of information are already written in the information storing element 22 during the manufacturing of the ink container 1.

The controller of the ink jet recording apparatus 50 reads the information written in the information storing element 22 when the ink container 1 is mounted. The ink jet recording apparatus 50 side stores reference data to be compared with the information written in the information storing element 22. The ink jet recording apparatus 50 compares the data of the ink container 1 with the data stored in the apparatus, and discriminates whether the ink container 1 is usable with the ink jet recording apparatus 50 or not, and/or whether the position of the ink container is correct or not, and if necessary, a warning is produced.

If the ink container 1 mounted on the apparatus is a recycled one which is refilled with the ink, the information storing element 22 of the ink remaining amount detection module 20 stores the data indicative of the absence of ink as the information relating to the ink remaining amount. Then, there arises a contradiction between the information provided by the detection electrode 23 and the information provided by the information storing element 22 as regards the ink remaining amount when a recycled ink container 1 is mounted on the ink jet recording apparatus 50.

In view of such a case, the controller of the ink jet recording apparatus 50 put preference on the information provided by detection electrodes 23, and the ink remaining amount information in the information storing element 22 is overwritten. By doing so, the contradiction can be avoided. Or, in the ink container manufacturing step during the recycling of the ink container 1, as well as during the manufacturing new ink containers, the information indicative of the presence of the ink may be written in the information storing element 22 after the ink is filled in the casing 4. Here, again, the writing of the information means writing and renewing of the information. For example, the information storing element 22 of a recycled ink container 1 already stores the information indicative of absence of the ink. In such a case, the data indicative of the absence of the ink may be rewritten or overwritten, or the data indicative of the presence of the ink may be written in another area in the information storing element 22. In the filling of the ink, the ink is filled such that ink contacts at least the detection electrode and the contacting ink continues to the ink supply port in the attitude of the ink container 1 in use.

By doing so, even when the recycled ink container 1 is mounted to the ink jet recording apparatus 50, the inconsistency between the information provided by the detection electrode 23 and the information provided by the information storing element 22 can be avoided. Even when it is not known whether the ink container 1 is an unused one of used one, from the appearance, the presence or absence of the ink in the ink container 1 can be easily and assuredly confirmed by reading out the information stored in the information storing element 22.

The most popular type of the ink jet recording apparatus 50 is a full-color type using a plurality of inks. Therefore, the ink jet recording apparatus 50 is loaded with a plurality of ink containers 1 containing different color inks, and the container bodies of the ink containers 1 of the different colors are common in many cases. The ink containers 1 for the different colors are to be set in the positions predetermined for the respective colors. In such a case, it is desirable for the information storing element 22 to have the information relating to the colors of the inks as well as the information relating to the ink remaining amount. Then, the controller of the ink jet recording apparatus 50 reads the information relating to the colors of the inks written in the information storing element 22, and checks whether the ink containers are set in the right positions, by which the erroneous mounting of the ink containers 1 can desirably be detected.

When such a color recording ink container 1 is recycled, the ink container 1 reused and recollected ink container 1 already has the information relating to the color of the ink written in the information storing element 22. Therefore, when the ink is refilled into the ink container 1, the information relating to the color of the ink is read out of the information storing element 22, and the ink of the color which is already written in the information storing element 22. By doing so, it is unnecessary to overwrite the information relating to the color of the ink. It is possible to fill the ink different from the color corresponding to the information relating to the color of the ink. In such a case, the data indicative of the color of the ink already written in the information storing element 22 is overwritten in compliance with the ink which is going to fill. When the ink container 1 is reused, it is desirable to clean the inside of the ink chamber before the ink is refilled. This is because the old ink is likely to remain in the ink container 1 even if the amount would be small, and the color mixture of the inks should be avoided. Even when the same color ink is refilled, or when the monochromatic recording is the case, and therefore, the information storing element 22 does not contain the information relating to the color of the ink, the small amount of the ink remaining in the ink chamber might have been deteriorated with time, and therefore, the cleaning of the ink chamber is desirable.

Figure 7:
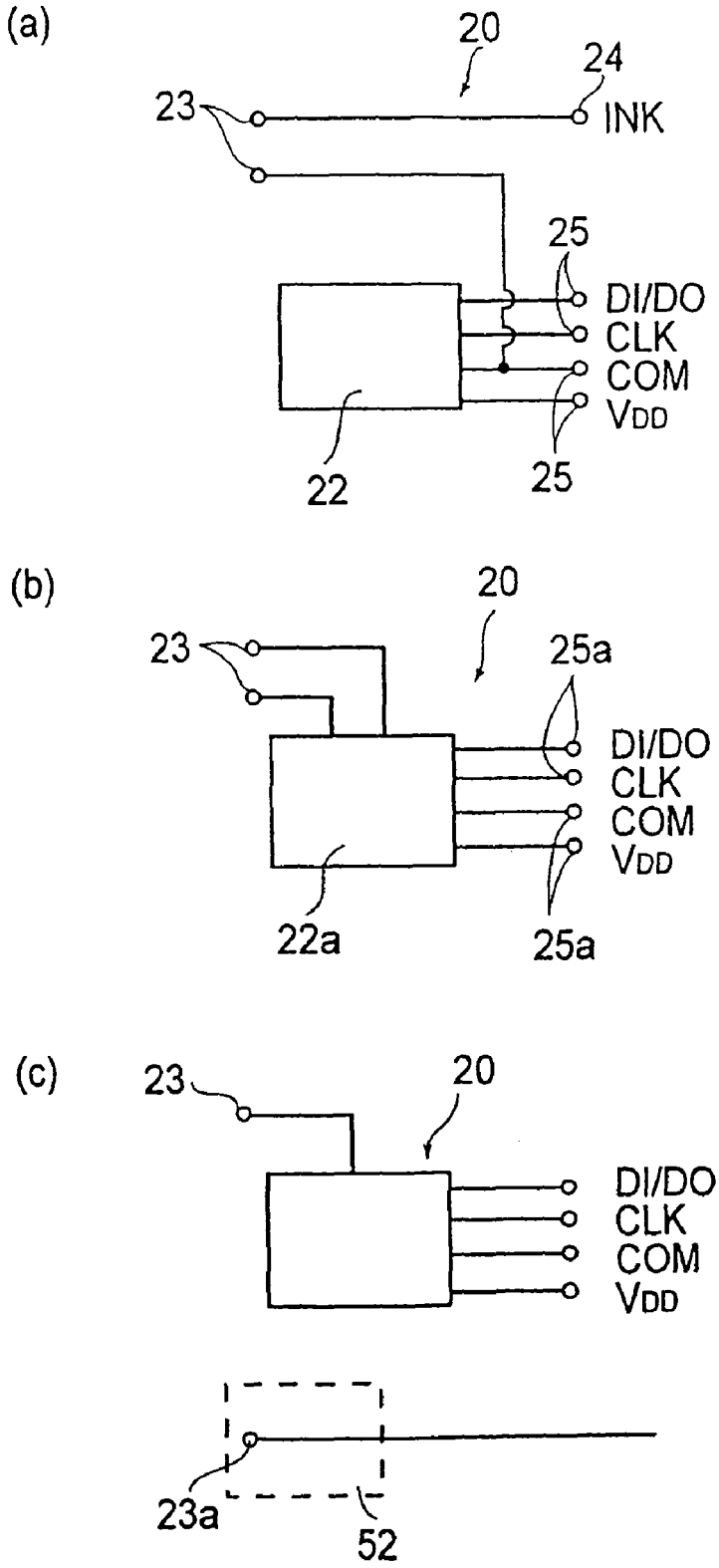
FIG. 7 illustrates an electrical structure of an ink remaining amount detection module according to another embodiment of the present invention.

The electrical structures of the ink remaining amount detection module 20 are not limited to that shown in FIG. 5. Referring to FIG. 7, (*a*)-(*c*), other embodiments of the electrical structures of the ink remaining amount detection module 20 will be described.

In the example shown in FIG. 7, (*a*), one of the external contact electrodes 24 to connect the detection electrodes 23 is common with the external contact electrode 25 contact COM for the element. In order to detect the current flowing between the detection electrodes 23, it is enough to apply a potential difference between the detection electrodes 23, in such a case one of them is electrically grounded. Since one of contacts of the information storing element 22 is grounded, it is commonly usable. By doing so, as compared with the example shown in FIG. 5, the number of the contact electrodes for external connection, of the ink remaining amount detection module 20 is reduced by one, and therefore, the number of the contacts in the ink jet recording apparatus side can be reduced by one. In other words, the number of the electrical connecting positions between the ink container and the ink jet recording apparatus is reduced, so that liability of improper contact can be reduced.

In the example shown in FIG. 7, (*b*), the information storing element 22*a* has an analog/digital process function. The information provided by the detection electrode 23 is analog information. If the information storing element 22*a* per se has a function of converting the analog information to the digital data of the type processible in the memory region of the information storing element 22*a*, the information provided by the detection electrode 23 can be directly inputted to the information storing element 22*a*, and the predetermined analog/digital process can be carried out in the information storing element 22*a*, and the information relating to the ink remaining amount may be stored in the memory region of the information storing element 22*a*, and can be inputted to and outputted from the ink jet recording apparatus through the external contact electrode 25*a*. With such a structure, the detection external contact electrode of the ink remaining amount detection module 20 and the detection contact of the ink jet recording apparatus side can be eliminated, and therefore, the number of the electrical connecting positions can be decreased. The information storing element 22*a* is not limited to a one-chip structure, but hybrid structure is usable.

In the example shown in FIG. 7, (*c*), the number of the electrodes contactable with the ink in the ink accommodation chamber 6 is one. The pair of the electrodes for the detection of the ink remaining amount, is not necessarily provided in the ink container if the current flowing between the electrodes through the ink can be detected. Therefore, in the example shown in FIG. 7, (*c*), one of the detection electrodes 23 is disposed in the ink remaining amount detection module 20, that is, in the ink container, and the other detection electrode 23*a* is disposed in the part of the recording head 52 which contacts the ink. The recording head 52 has elements (unshown) for ejecting the ink, and various electric circuits are provided for the ink ejection, and a part of such electric circuits may be used for the detection electrode 23*a*. For example, when the recording head is of such a type that ink is used by an electrothermal transducer element to create a film boiling in the ink, and the ink is ejected using the pressure of the bubble produced by the film boiling, the surface of the electrothermal transducer element is provided with a Ta film as anti-cavitation film in many cases. The Ta film is usable as one of the detection electrode 23*a*, that is, the electrode 23*a* to be disposed in the recording head 52. With this structure, the number of the electrodes of the ink remaining amount detection module 20 can be further reduced.

Figure 8:
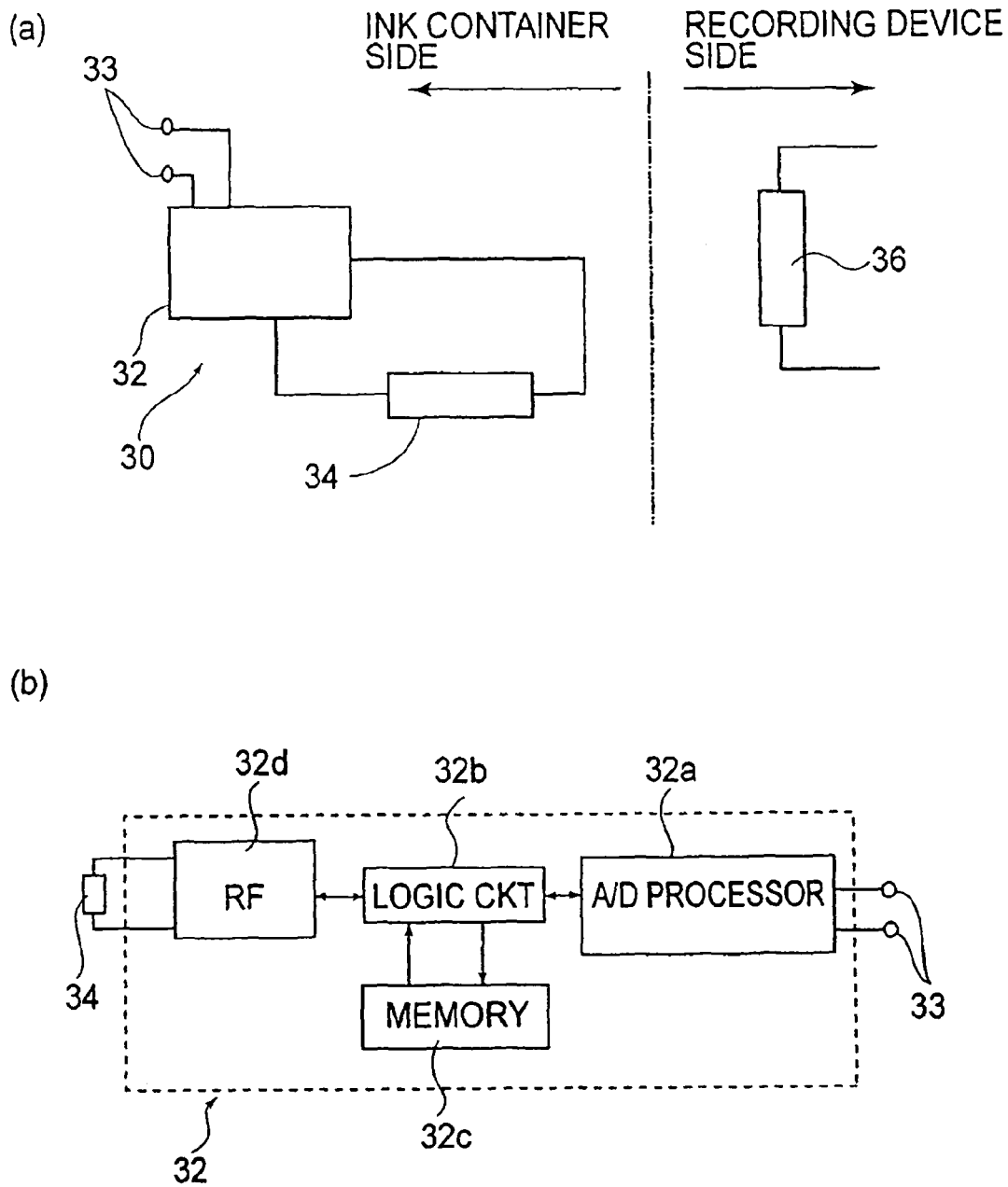
FIG. 8 illustrates an electrical structure of example of an ink remaining amount detection module of a non-contact type according to an embodiment of the present invention.

In FIG. 7, (*a*)-(*c*), the information transmission between the ink container and the ink jet recording apparatus is effected by physical contacts. But, it may be of non-contact type. FIG. 8 shows such an example.

The ink remaining amount detection module 30 shown in FIG. 8 uses a so-called RF-ID (Radio Frequency Identification) and effects non-physical-contact information transmission with use of high frequency radio wave of an order of several GHz (micro-wave). There is provided an antenna portion 34 for communication among a pair of detection electrodes 33, an information storing element 32, an information storing element 32 and the ink jet recording apparatus. The detection electrodes 33, the information storing element 32 and the antenna portion 34 are provided on a support substrate (unshown). The detection electrode 33 and the information storing element 32 are provided on one side of the support substrate so as not to physically expose to the outside of the ink container. The antenna portion 34 is disposed on the side opposite the side having the detection electrode 33 and the information storing element 32 in order to minimize absorption of the high frequency energy of the radio wave by the ink in the ink container. On the other hand, the ink jet recording apparatus is provided with an antenna portion 36 for transmission and reception of information between the ink remaining amount detection module 30 and itself.

As shown in FIG. 8, (*b*), the information storing element 32 comprises a memory region 32*c* for storing information inherent to the ink container and/or the information relating to the ink remaining amount; an analog/digital processing portion 32*a* for converting the analog information from the detection electrode 33 to digital information; a RF portion (high frequency processing portion) 32*d*, connected to the antenna portion 34, for converting the RF signal to digital signal and for converting the digital signal to a RF signal; a logic portion 32*b* for converting the type of the digital information converted by the analog/digital processing portion 32*a* to the data type relating to the ink remaining amount, for writing the converted data relating to the ink remaining amount in the memory region 32*c*, for sending the converted data relating to the ink remaining amount to the RF portion 32*d*, and for controlling the signal sending and receiving among the analog/digital processing portion 32*a*, the memory region 32*c* and the RF portion 32*d*.

The structures of the information storing element 32 shown in FIG. 8, (*b*) are similar to the structures of the information storing element shown in FIG. 7, (*b*) and, (*c*) except that provision of the RF portion 32*d*. The information storing element shown in FIG. 7, (*b*) and, (*c*) includes wiring for connection with the contact, in place of RF portion 32*d* of FIG. 8, (*b*).

By the above-described structures for non-contact transmission and reception of the signals, the necessity for the contacting structure for the transmission of the information between the ink remaining amount detection module 30 and the ink jet recording apparatus is eliminated, so that simple structure is accomplished, and the latitude of the position of the ink remaining amount detection module 30 is significantly improved.

In the foregoing description of the non-physical-contact type, the use has been made with RF-ID using high frequency radio wave of the order of GHz as the information storing element. The use can be made with RF-ID of an electromagnetic induction connection by using high frequency electromagnetic induction, although the compactness is not as good as the RF-ID using the high frequency radio wave. In such a case, the advantage of the information storing means integral with the ink remaining amount detecting means. When the electromagnetic induction is used, the antenna portion is a loop coil antenna.

When the information storing element having the analog/digital process function is used as in the information storing element described in conjunction with FIG. 7, (*b*), (*c*) and FIG. 8, the information storing element per se may switch the storing method in the memory region, and may switch the discrimination algorithm on the basis of the remaining amount information of the ink container. By doing so, the limited memory area can be used efficiently when, for example, the ink remaining amount is detected stepwisely not only when only the presence/absence is detected. As a result, the memory size of the information storing element can be made small, and therefore, the cost can be saved, and the ink remaining amount detection module can be downsized.

The description will be made as to the ink container usable with the present invention. In the foregoing embodiments, the ink container 1 has an ink accommodation chamber 6 and the negative pressure generating member accommodating chamber 5 (FIG. 1), but the present invention not limited to such examples.

Figure 9:
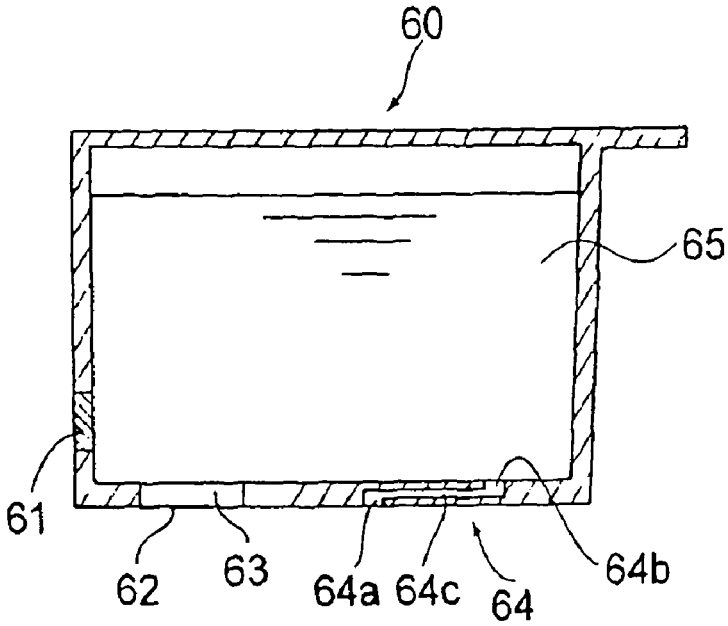
FIG. 9 is a sectional view of an ink container according to another embodiment of the present invention.

FIG. 9 is a sectional view of an ink container to which the present invention is used. The ink container 60 shown in FIG. 9, the entire of the inner space of the casing is used to directly accommodate the ink (ink accommodation chamber 65). The bottom wall of the ink container 60 is provided with an ink supply port 62 for supplying the ink into the recording head (unshown). The ink supply port 62 is provided with an elastic valve film 63. When the ink container 60 is mounted to the ink jet recording apparatus (unshown), the 63 ink container 60 opens only when the ink discharge tube (unshown) is inserted thereinto, by which the ink is prevented from leakage from the ink container 60 in the state that ink container 60 is not mounted on the ink jet recording apparatus.

The bottom wall of the ink container 60 is provided with a negative pressure generating structure 64 for generating a negative pressure in the ink accommodation chamber 65. The negative pressure generating structure 64 comprises a first recess 64*a* formed in the outer surface of the ink container 60, a second recess 64*b* formed in the inside surface of the ink container 60, and an interconnection passage 64*c* for connecting the recesses 64*a*, 64*b* with each other. The interconnection passage 64*c* may be a meander passage, for example. The internal pressure of the ink container 60 is lower than the external pressure, and the ink forms meniscus in the second recess 64*b* and is retained in the ink accommodation chamber 65. When the internal pressure lowers with the consumption of the ink, the air is introduced into the ink accommodation chamber 65 through the interconnection passage, so that inside of the ink accommodation chamber 65 is maintained at a predetermined negative pressure.

An ink remaining amount detection module 61 is mounted on the side wall of the ink container 60. The ink remaining amount detection module 61 may be of any one of the above-described types, and is mounted such that detection electrode (unshown) contacts the ink in the ink accommodation chamber 65. When the ink remaining amount detection module 61 is mounted on the side wall of the ink container 60 in such a manner, the ink liquid surface level at which the absence of ink is to be detected can be properly determined by selecting the mounting position of the ink remaining amount detection module 61 with respect to the vertical direction in orientation of the ink container 60 in use. Three or more detection electrodes may be mounted at different height positions so as not deteriorate the advantage of the compactness of the ink remaining amount detection module 61. Then, by detecting the states of electric conductions between the respective detection electrodes, the intermediate ink remaining amounts can be stepwisely detected including the intermediate level.

Figure 10:
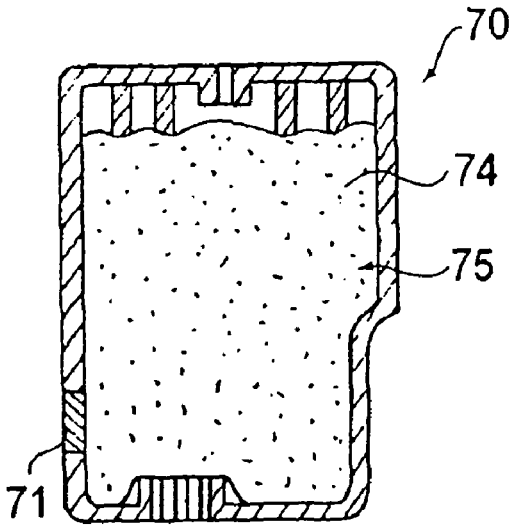
FIG. 10 is a sectional view of an ink container according to a further embodiment of the present invention.

FIG. 10 is a sectional view of an ink container to which the present invention is used. In the example of FIG. 10, the entirety of the inside of the casing is a negative pressure generating member accommodating chamber 75 accommodating the negative pressure generating member 74 for retaining the ink. The ink container 70 has substantially the same structures as the ink container 1 shown in FIG. 1 from which the ink accommodation chamber 6 is omitted, and therefore, the detailed description thereof is omitted.

In this example, the ink remaining amount detection module 71 is mounted on the side wall of the ink container 70. The ink remaining amount detection module 71 of this example, similarly to the example of FIG. 9, may be any one of the foregoing embodiments is usable, and the detection electrode (unshown) is mounted so as to contact the ink in the negative pressure generating member accommodating chamber 75. By using three or more detection electrodes may be mounted for stepwise ink remaining amount detection, similarly to the example of FIG. 9. In this example, however, the ink contacts the detection electrode in the state that ink is absorbed in the negative pressure generating member 74. It is desirable that capillary tube grooves shown in FIG. 3 are formed around the detection electrode, and the capillary force of the negative pressure generating member 74 and the capillary force of the capillary tube groove are properly selected such that electrical connection between the detection electrodes opens at the desired level of ink in the ink container 70. The structures shown in FIG. 10 are usable with the ink container 1 of FIG. 1.

Figure 11:
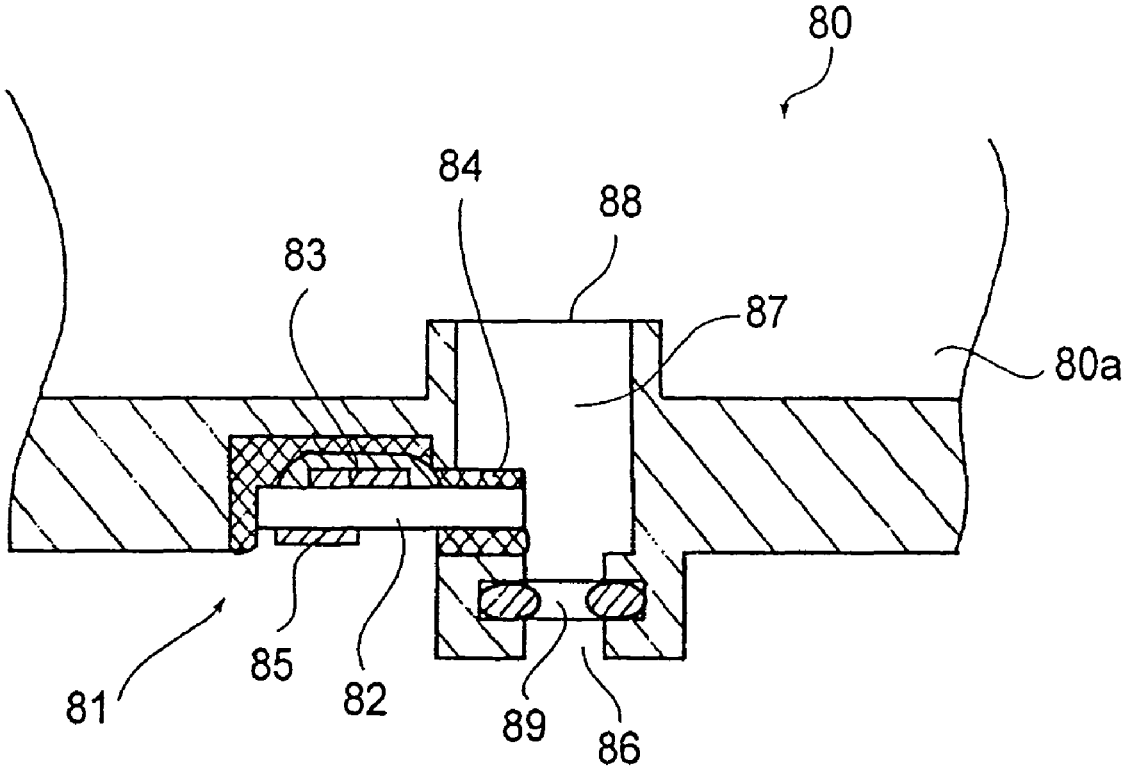
FIG. 11 is a sectional view of the ink container around the ink remaining amount detection module according to a further embodiment of the present invention.

FIG. 11 is a sectional view of the structure around an ink remaining amount detection module according to a further embodiment of the present invention. In the ink container 80 shown in FIG. 11, the ink remaining amount detection module 81 is disposed in the ink supply port 86. The ink chamber 80*a* may directly accommodates the ink, or may retain the ink by a negative pressure generating member by absorption. Inside the ink supply port 86, there is provided a filter 88 at the end adjacent the ink chamber 80*a*, and an elastic valve film 89 is provided at the ink outlet side end, so that middle chamber 87 is defined between the filter 88 and the elastic valve film 89.

The ink remaining amount detection module 81 is fixed to the ink container 80 such that one end portion of one side of the support substrate 82 is exposed to the inside of the middle chamber 87, and a part of the other side is exposed to the outside of the ink container 80. The detection electrode 84 is formed in the region of one side of the support substrate 82 projected into the middle chamber 87. The information storing element 83 is carried on one surface of the support substrate 82 and is sealed by a sealant. The region of the other side of the support substrate 82 exposed to the outside of the ink container 80 has an external contact electrode 85 for electrical connection with the outside. The gap between the ink remaining amount detection module 81 and the ink container 80 is sealed by the adhesive material. With such a structure of the ink remaining amount detection module 81, the ink remaining amount in the ink container 80 can be detected, and the information relating to the ink remaining amount can be storing.

In order to further assure the advantageous effects of the present invention, the detection electrode is disposed at a position corresponding to the amount of the ink at which the remaining amount detection is to be detected, and the ink is filled so as to contact the detection electrode, and the filled ink continues to the neighborhood of the providing. This applies to the case of refilling the ink into a recycled ink container.

While the invention has been described with reference to the structures disclosed herein, it is not confined to the details set forth and this application is intended to cover such modifications or changes as may come within the purpose of the improvements or the scope of the following claims.

This application claims priority of Japanese Patent Application No. 165889/2004 filed Jun. 3, 2004, which is hereby incorporated by reference.

What is claimed is:

1. A manufacturing method for an ink container including an ink chamber accommodating ink therein and an ink supply port for supplying the ink from the ink chamber into a recording head, said method comprising:

a preparing step of preparing a casing member constituting an outer wall of said ink chamber and said ink supply port, wherein an ink remaining amount detection module is mounted on a bottom of said ink chamber, wherein said ink remaining amount detection module comprises a support substrate having first and second sides opposite to each other;

a plurality of detection electrodes provided on the first side of said support substrate and exposed to inside of said ink chamber;

readable and writable non-volatile information storing means provided on said support substrate and a plurality of contact electrodes provided on the second side of said support substrate;

wherein said contact electrodes are electrically connected to at least one of said plurality of the detection electrodes and said information storing means;

wherein recesses are provided on said casing member and said detection electrodes are provided in said recesses, respectively, wherein a wall is configured at a position between said recesses and wherein said information storing means is covered by said wall between each of said recesses, and wherein the first side is faced inward of said casing so that said ink detection electrodes are exposed toward the ink said method further comprising:

a filling step of filling ink into said ink chamber; and a writing step of writing information indicative of presence of ink in said information storing means of said ink remaining amount detection module after the filling step.

2. A manufacturing method according to claim 1, wherein said information storing means has already written information indicative of absence of ink, and said writing step renews the already written information.

3. A manufacturing method according to claim 2, wherein said information storing means has already written information relating to a color of ink, and wherein said filling step fills the ink of a color different from said already written color, and said method further comprising:

a step of renewing the information relating to the color of the ink.

4. A manufacturing method according to claim 2, further comprising a step of cleaning said ink chamber before said ink filling step.

5. A manufacturing method according to claim 1, further comprising a step of writing information relating to a color of the ink to fill in said information storing means of said ink remaining amount detection module.

6. A manufacturing method according to claim 1, wherein said information storing means has already written information relating to a color of ink, and said ink filling step fills the ink of said color.

7. A manufacturing method according to claim 1, wherein said writing step writes information indicative of presence of ink in said information storing means on the basis of a current flowing between said contact electrodes of the ink remaining amount detection module.

8. A manufacturing method according to claim 1, wherein said wall is configured of said casing member.

* * * * *